US008459778B2

(12) United States Patent
Lahut et al.

(10) Patent No.: US 8,459,778 B2
(45) Date of Patent: Jun. 11, 2013

(54) REDUCED GLOSS BANDING THROUGH LOW INK VOLUME DEPOSITION PER PRINT PASS

(75) Inventors: Joseph A. Lahut, Moultonboro, NH (US); Dwight Cram, Concord, NH (US); John Duffield, Meredith, NH (US); Peter Heath, Alexandria, NH (US)

(73) Assignee: Electronics For Imaging, Inc., Foster City, CA (US)

( * ) Notice: Subject to any disclaimer, the term of this patent is extended or adjusted under 35 U.S.C. 154(b) by 104 days.

(21) Appl. No.: 13/218,296

(22) Filed: Aug. 25, 2011

(65) Prior Publication Data

US 2013/0050339 A1 Feb. 28, 2013

(51) Int. Cl.
*B41J 2/21* (2006.01)

(52) U.S. Cl.
USPC ..... 347/43; 347/15; 347/41

(58) Field of Classification Search
USPC ..... 347/9–12, 14, 15, 16, 40–43, 54
See application file for complete search history.

(56) References Cited

U.S. PATENT DOCUMENTS

| | | | | |
|---|---|---|---|---|
| 6,145,979 | A | 11/2000 | Caiger et al. | |
| 6,457,823 | B1 | 10/2002 | Cleary | |
| 6,739,716 | B2 | 5/2004 | Richards | |
| 6,789,867 | B2 | 9/2004 | Takahashi et al. | |
| 7,152,969 | B2 | 12/2006 | Hintermann | |
| 7,152,970 | B2 | 12/2006 | Hasebe et al. | |
| 7,600,867 | B2 | 10/2009 | Mills et al. | |
| 7,837,319 | B2 | 11/2010 | Rodin et al. | |
| 8,201,909 | B2 * | 6/2012 | Barbour et al. | 347/14 |
| 2010/0289860 | A1 | 11/2010 | Takezawa et al. | |
| 2011/0069128 | A1 | 3/2011 | Onishi | |

FOREIGN PATENT DOCUMENTS

| | | |
|---|---|---|
| EP | 471488 | 2/1992 |
| EP | 0518670 | 12/1992 |
| EP | 0665114 | 8/1995 |

* cited by examiner

*Primary Examiner* — Thinh Nguyen
(74) *Attorney, Agent, or Firm* — Michael A. Glenn; Glenn Patent Group

(57) ABSTRACT

Improved output quality of a printer used in UV curable ink jet printing is achieved by minimizing or eliminating a print artifact referred to as gloss banding or tire tracking. A same or a similar number of nozzles as used in conventional printers is used to achieve a desired throughput, but the nozzles are arranged so that any given square inch of substrate to which ink is being applied receives a lower amount of ink. A longer effective print head is provided by arranging the print heads into a longer array, where the print heads are butted substantially end-to-end. As a result, the net throughput of the printer is the same as that of a conventional printer because the printer uses the same number of print heads, but the amount of ink that is applied to any given square inch is less on a pass.

19 Claims, 13 Drawing Sheets

ONE COLOR
Head # / Nozzle #

Heavy Smoothing fill pattern 4 passes
Head offsets = vertical resolution = for example, 360 dpi (dots per inch)
horizontal resolution, for example = 600 dpi

H1 H2

Pass #1 left to right, Diffusion fill 1/4

```
1          X   X     X     X   X           X   X     X     X
     1         X         X X       X         X
2          X   X       X       X X         X     X     X
     2             X   X   X     X       X     X
           X         X     XX            X       X
```

Pass #2 right to left, Diffusion fill 1/4

```
125        X   X     X     X   X   X     X   X     X     X
     125       X   X     X X   X     X X   X     X X     X
126        X   X   X     X   X   X     X X   X     X     X
     126           X   X     X   X     X X   X       X   X
           X   X   X X   X   X   XX    X X   X     X X   X
```

Pass #3 left to right, Diffusion fill 1/4

```
253        X   X X   X X X X   X   X   X X   X     X X   X X
     253       X   X   X X X X X   X   X X   X X   X   X X
254        X X X   X X   X   X X X   X X X     X X   X
     254   X   X X X   X   X X   X X X X X X     X   X X
           X X X   X X   X   X   XX    X X   X X   X   X
```

Pass #4 right to left, Diffusion fill 1/4

```
377        X X X X X X X X X X X X X X X X X X X X X X X X X
     377   X X X X X X X X X X X X X X X X X X X X X X X X X
378        X X X X X X X X X X X X X X X X X X X X X X X X X
     378   X X X X X X X X X X X X X X X X X X X X X X X X X
           X X X X X X X X X X X X X X X X X X X X X X X X X
```

FIG. 4
(Prior Art)

*Example of 3 heads 540 dpi vertical projection*
*total nozzles = 3 x 510 = 1530*
*Net throughput in 2 pass mode = 900 sfh*
*Carriage traverse #1*
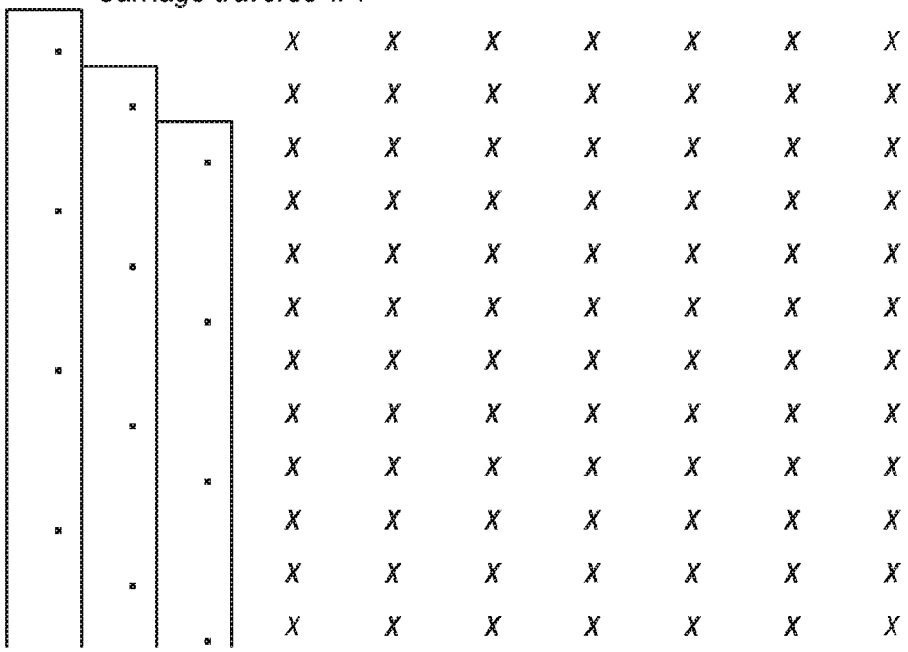
*Carriage traverse #2*
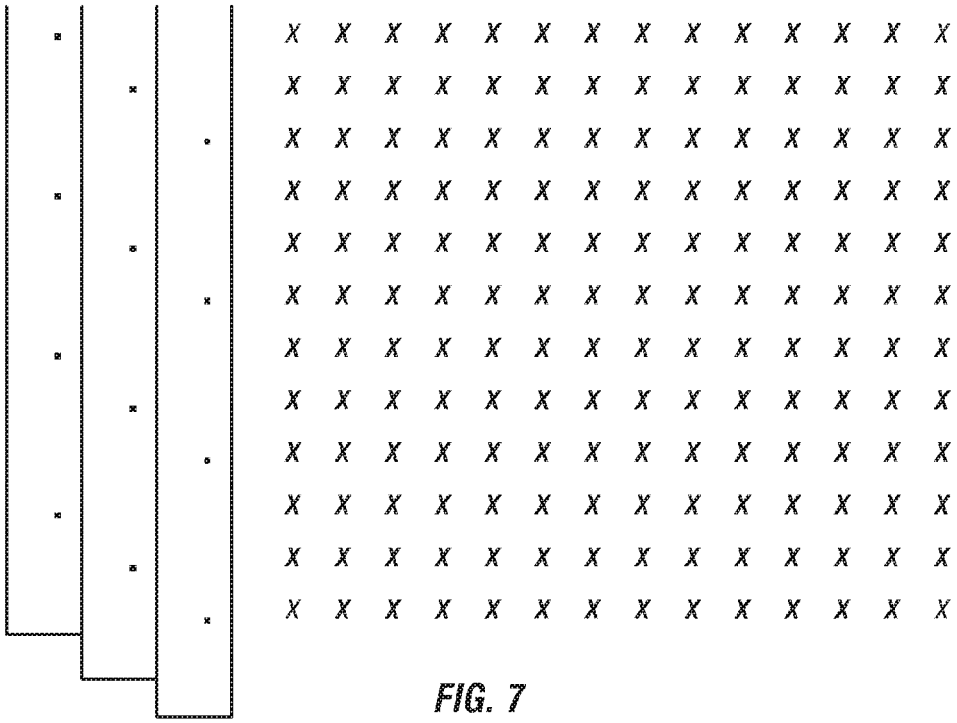
*FIG. 7*
*(Prior Art)*

*Example of 3 heads 180 dpi vertical projection*
*total nozzles = 3 x 510 = 1530*
*Net throughput in 2 pass mode = 900 sfh*
*Carriage traverse #1*
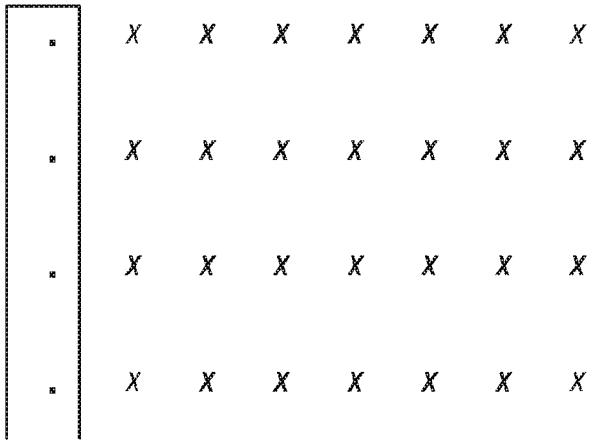
*Carriage traverse #2*
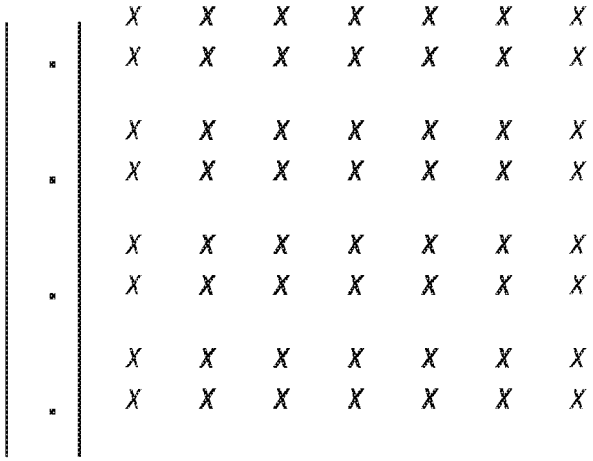
*Carriage traverse #3*
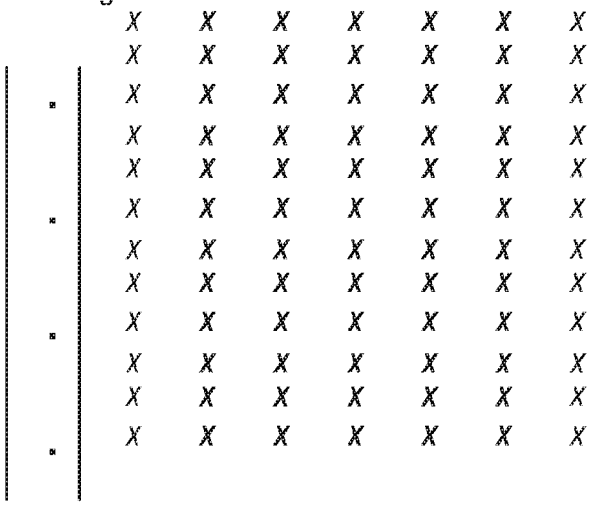
*FIG. 8*

*Carriage traverse #4*
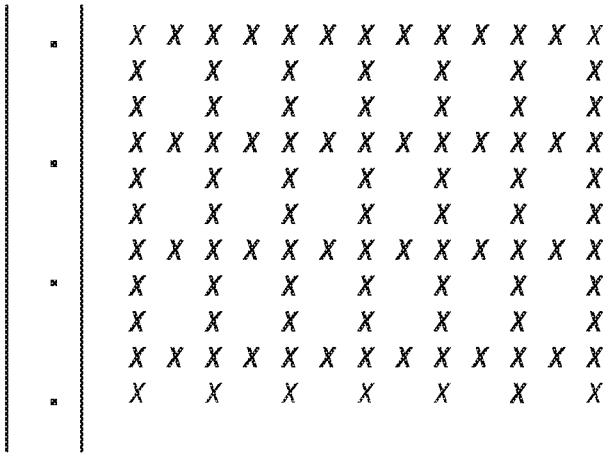
*Carriage traverse #5*
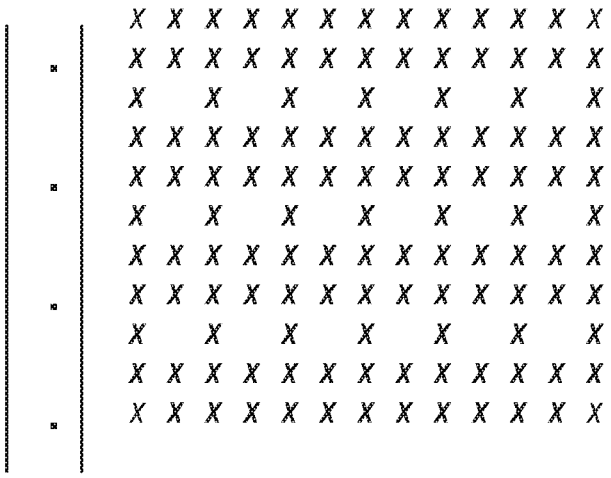
*Carriage traverse #6*
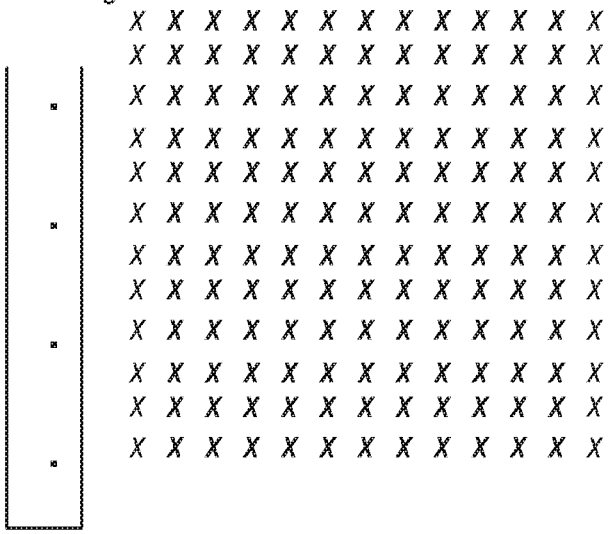
*FIG. 8 (Cont'd)*

| GS3200 Printer | Printing Resolution Horiz x Vert, dpi | Rate of Laydown per pass | with max at 240% | |
|---|---|---|---|---|
| | | | Gloss 85 deg | Differential Gloss |
| 8 color Sym HS | 150 x 180 | 15% | 8.1 | 0.1 |
| 8 color Sym NS | 300 x 180 | 30% | 12.5 | 0.2 |
| FF Sym HS | 150 x 360 | 50% | 15 | 1 |
| FF Sym NS | 300 x 360 | 100% | 32.2 | 2 |

| | Printing Resolution Horiz x Vert, dpi | Rate of Laydown per pass | with max at 200% | |
|---|---|---|---|---|
| | | | Gloss 85 deg | Differential Gloss |
| GS3200 FF NS | 300 x 360 | 100% | 26 | 4 |
| GS3200 FF HS | 150 x 360 | 50% | 13 | 1 |
| 6 Deep FF NS | 300 x 180 | 50% | 10.5 | 3 |
| 6 Deep FF HS | 150 x 180 | 25% | 7 | 1.3 |

REDUCED GLOSS BANDING THROUGH LOW INK VOLUME DEPOSITION PER PRINT PASS

BACKGROUND OF THE INVENTION

1. Technical Field

The invention relates to ink jet printers. More particularly, the invention relates to an ink jet printer having low ink volume deposition per print pass.

2. Description of the Background Art

Digital UV inkjet printers have been in commercial production since 2000. The early printers used relatively low resolution print heads (90-100 dpi) with low numbers of nozzles per color (256-512) and printed at rates of approximately 250 square feet per hour (sf/h). Over time, the native resolutions of print heads have increased and the number of nozzles per color has increased in an attempt to build faster and faster printers. To achieve the higher print speeds, printer designers have arrayed multiple print heads in efficient arrangements where high resolution can be achieved as multiples of the native resolutions of the individual print heads. For instance, as in the EFI Vutek QS3200r, three Seiko print heads, native 180 dpi of 510 nozzles each can be arranged as three print heads per color in an array of 540 dpi of 1530 nozzles per color. Where a single print head per color results in a printer of 300 sf/h, the multi-head array printer has a top throughput of 900 sf/h.

As moving carriage printers have been designed to increase throughput (speed), the number of nozzles and step size have increased leading to substantial issues with an artifact variously referred to as tire tracking, gloss banding, or differential gloss banding. The artifact manifests in a differential gloss between passes, e.g. left to right versus right to left, of the last pass printed by the print heads over the substrate.

The period of banding is the step size of the media under the traversing print heads. The result is similar to viewing a mowed lawn or baseball field and seeing the directional passes of the lawn mower. In UV inkjet printing this differential gloss is a highly objectionable artifact that limits the speed of the printer and usefulness of the printed image in high image quality applications, such as point-of-purchase (POP) signage.

A substantial amount of work has been done to minimize this highly objectionable artifact. Countermeasures that are used to minimize gloss banding, require more interlacing, and thus lead to reduced throughput of the printer, i.e. more passes at lower resolutions and smaller step sizes to reduce gloss banding and other print artifacts reduce throughput to one-half or less of the maximum speed capability of the printer. State of the art corrective methods that attempt to address this problem may be understood by resort to, for example, U.S. Pat. No. 6,789,867 and European patent nos. EP06651, EP471488A, and EP0518670.

It would be advantageous to provide a technique for UV curable ink jet printing that improves the output quality of a printer by minimizing or eliminating gloss banding or tire tracking.

SUMMARY OF THE INVENTION

An embodiment of the invention provides a method and apparatus for UV curable ink jet printing that improves the output quality of a printer by minimizing or eliminating a print artifact referred to as gloss banding or tire tracking. In the state of the art, as more ink is applied in a pass, there is liquid-to-liquid interaction before the substrate goes under a pinning lamp or a curing lamp, and this produces the gloss banding or tire tracking artifact. In the past, dense application of ink has been thought to be a very desirable way of forming an image because it is the most compact, and thus provides the most throughput. An embodiment of the invention uses the same or a similar number of nozzles to achieve a desired throughput, but the nozzles are arranged so that at any given square inch of substrate to which ink is being applied receives a lower amount of ink. To accomplish this, an embodiment of the invention applies ink to the substrate over a larger distance, where the ink is applied, counter-intuitively, in a less dense fashion. This approach allows the droplets of ink to be pinned or frozen without the liquid-to-liquid interaction that occurs when ink is applied with less spacing between the ink drops.

In the state of the art, if a native print head having a resolution of 180 dpi is used, and the printer is to apply print at 360 dpi, then two heads are placed next to one another and offset by a 360th of an inch. If a print resolution of 540 dpi is desired, then three print heads are placed together and offset by a 540th of an inch. As a result, the amount of ink applied to the substrate in a pass is quite large.

In one embodiment of the invention, a longer print head is provided. Thus, instead of arranging the print heads next to each other, the print heads are arranged into a longer array, for example they are butted substantially end-to-end. In this way, the density of the ink applied to the surface of the substrate by the print head array stays at, for example 180 dpi, but the print heads are arranged along their lengths rather than next to one another. As a result, the net throughput of the printer is the same, e.g. 540 dpi, because the printer uses the same number of print heads, but the amount of ink that is applied to any given square inch is less on a pass because ink is applied over more of the length of the substrate, with the result that the same net area of the substrate surface is covered.

BRIEF DESCRIPTION OF THE DRAWINGS

FIG. 4 is a schematic diagram that shows a heavy smoothing mode of printing;

FIG. 7 is a schematic diagram that shows a first dot lay down pattern for enhanced or two-pass printing using a state of the art head arrangement;

FIG. 8 is a schematic diagram that shows a dot lay down pattern for enhanced or two-pass printing using the novel head arrangement according to the invention;

DETAILED DESCRIPTION OF THE INVENTION

Figure 1:
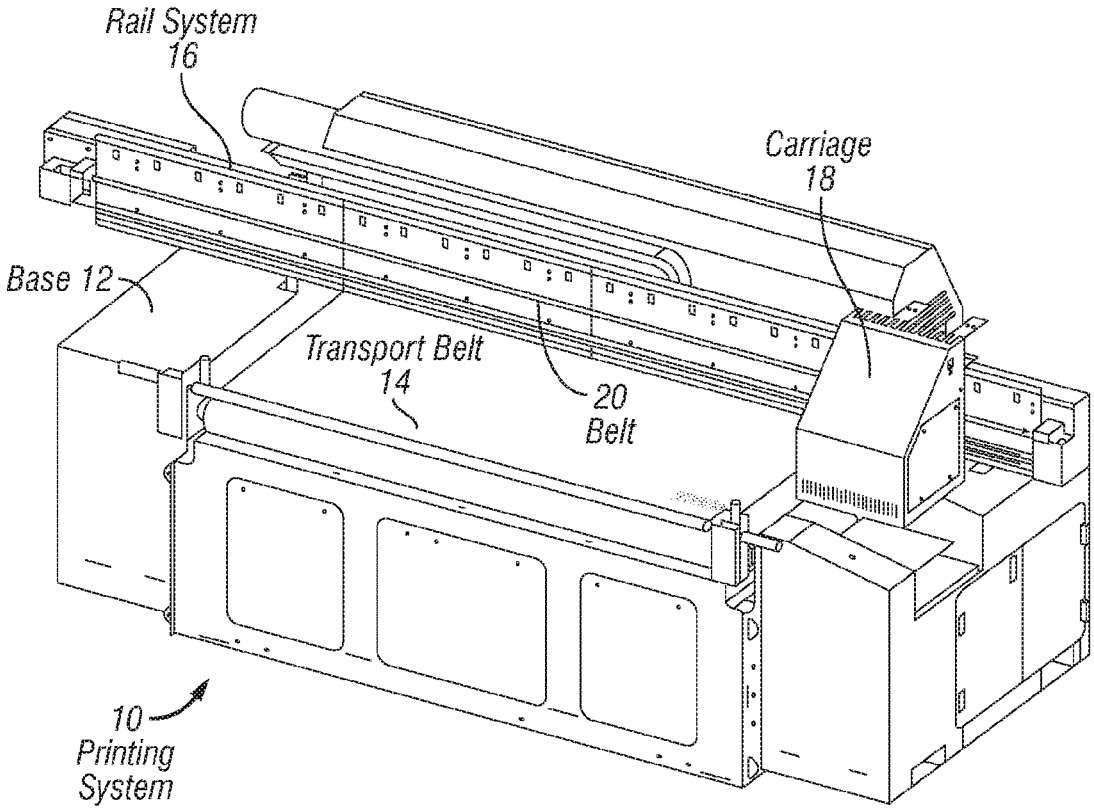
FIG. 1 (Prior Art)
FIG. 1 is an isometric view of a common printing system adapted for printing images on a variety of substrates.

An embodiment of the invention provides a method and apparatus for UV curable ink jet printing that improves the output quality of a printer by minimizing or eliminating a print artifact referred to as gloss banding or tire tracking. In the state of the art, as more ink is applied in a pass, there is liquid-to-liquid interaction before the substrate goes under a pinning lamp or a curing lamp, and this produces the gloss banding or tire tracking artifact. In the past, dense application of ink has been thought to be a very desirable way of forming an image because it is the most compact, and thus provides the most throughput. An embodiment of the invention uses the same or a similar number of nozzles to achieve a desired throughput, but the nozzles are arranged so that at any given square inch of substrate to which ink is being applied receives a lower amount of ink. To accomplish this, an embodiment of the invention applies ink to the substrate over a larger distance, where the ink is applied, counter-intuitively, in a less dense fashion. This approach allows the droplets of ink to be pinned or frozen without the liquid-to-liquid interaction that occurs when ink is applied with less spacing between the ink drops.

In the state of the art, if a native print head having a resolution of 180 dpi is used, and the printer is to apply print at 360 dpi, then two heads are placed next to one another and offset by a 360th of an inch. If a print resolution of 540 dpi is desired, then three print heads are placed together and offset by a 540th of an inch. As a result, the amount of ink applied to the substrate in a pass is quite large.

In contrast thereto, an embodiment of the invention provides a plurality of print heads, in which each print head comprises a plurality of substantially adjacent ink nozzles positioned within the print head to define an array of nozzles having m nozzle columns with n nozzles per column. The print head nozzle columns define a native vertical resolution for the print head. The print heads are arranged to position the nozzles within each of the print heads for any one color of ink substantially end-to-end with those nozzles of each other print head on a printing system carriage that is formed to hold the print heads in a configuration that jets out ink individually from each of the nozzles onto a substrate during a multi-pass printing application. Thus, in one embodiment of the invention, a longer print head is provided. Thus, instead of arranging the print heads next to each other, the print heads are arranged into a longer array, for example they are effectively butted substantially end-to-end. As a practical matter, what this means is that the heads may be staggered slightly to account for that fact that nozzles within each head are set slightly inwardly from each end of the head. In most cases, actually butting the heads end-to-end would produce a gap between the nozzles of the abutting heads. Thus, in some embodiments, the heads are effectively placed end-to-end in that the nozzles in each head to deposit ink in a continuous fashion along the length of the heads.

Accordingly, the length of the array is the number of nozzle columns×the number of nozzles per column×the resolution of the nozzle columns. For example, consider an array of six heads, each of which may have two nozzle columns at 90 dpi for an array resolution of 180 dpi×508 nozzles per head×6 heads=3024 nozzles at a native resolution of 180 dpi. In another example, consider an array of twelve heads at 90 dpi native resolution at 254 nozzles per head, where the heads are arranged in pairs offset by 1/180." This array is identical to the immediately preceding arrangement.

Thus, the density of the ink applied to the surface of the substrate by the print head array stays at, for example 180 dpi, but the print heads are arranged along their lengths rather than next to one another. As a result, the net throughput of the printer is the same, e.g. 540 dpi, because the printer uses the same number of print heads, but the amount of ink that is applied to any given square inch is less on a pass because ink is applied over more of the length of the substrate, with the result that the same net area of the substrate surface is covered.

FIG. 1 is an isometric view of a prior art printing system 10, adapted for printing images on a variety of substrates. The printing system 10 includes a base 12, a transport belt 14 which moves the substrate through the printing system, a rail system 16 attached to the base 12, and a carriage 18 coupled to the rail system 16. The carriage 18 holds a series of inkjet print heads (not shown) and is attached to a belt 20 which wraps around a pair of pulleys (not shown) positioned on either end of the rail system 16. A carriage motor is coupled to one of the pulleys and rotates the pulley during the printing process. As such, when the carriage motor causes the pulley to rotate, the carriage moves linearly back and forth along the rail system 16.

In the printer of FIG. 1, as the substrate moves through the system 10, the inkjet print heads deposit ink onto the substrate. The carriage 18 moves along the rail system 16, depositing ink on the substrate as it traverses the rail system 16. Upon the completion of a traversal, the substrate steps ahead by movement of the transport belt 14 to position the substrate for a return traversal and subsequent ink deposit.

The carriage 18 holds a group of print heads configured to jet out ink individually onto the substrate during a multi-pass printing application. Those skilled in the art will appreciate that the printer shown in FIG. 1, and described above, is only one type of printer of many that may be used to practice the invention disclosed herein.

Figure 2:
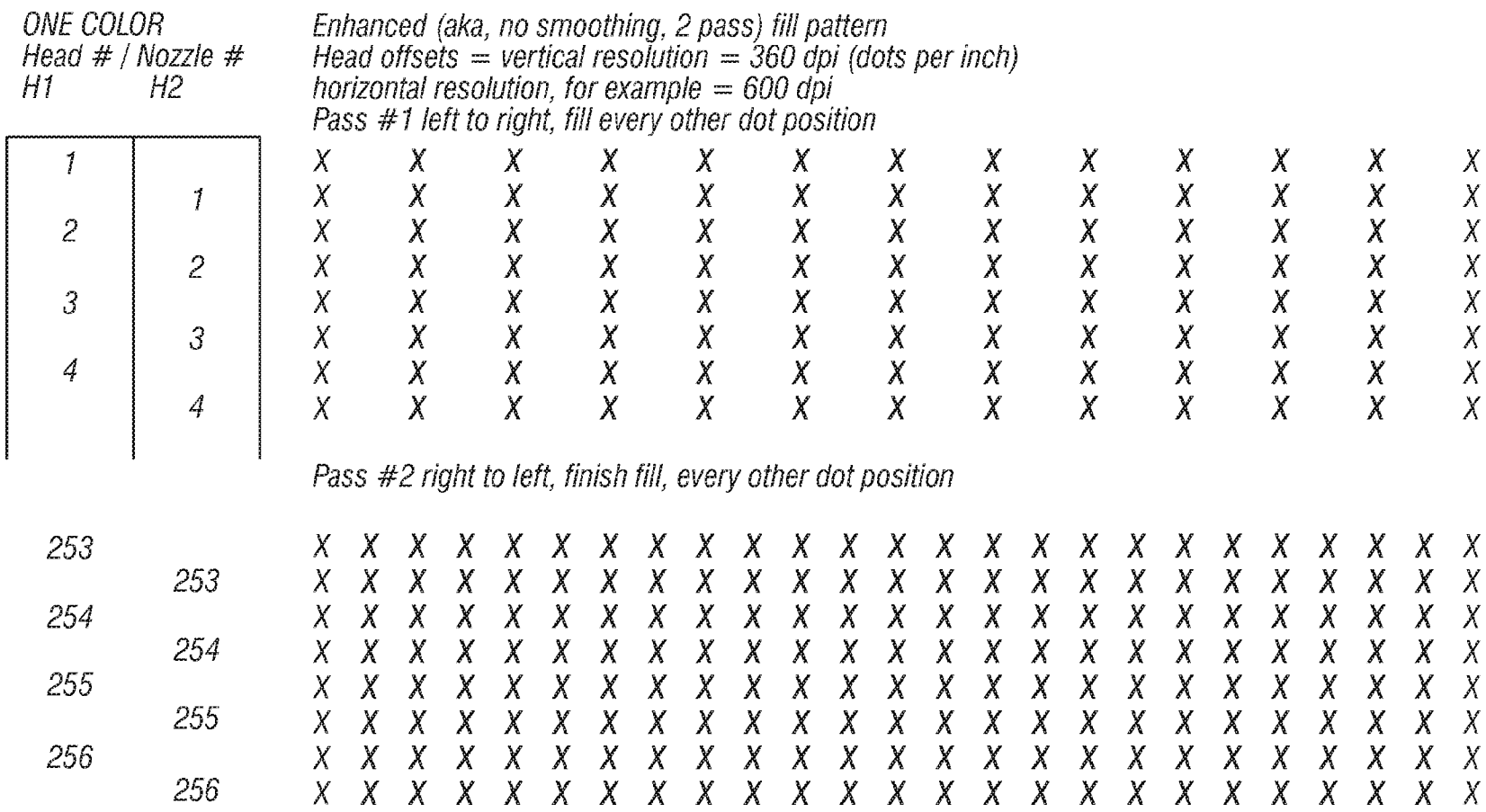
FIG. 2 (Prior Art)
FIG. 2 is a schematic diagram that shows an enhanced, no smoothing, or two-pass mode of printing.

In the state of the art, there are three basic methods of ink lay down or interlacing. The first such method is referred to as enhanced, no smoothing, or two-pass mode. In this mode, each horizontal dot line is printed by two different print head nozzles. On one pass, the odd number pixel or dots are printed, the media is advanced and, on the return pass, the even numbered dots are printed by a different set of nozzles. The major reason for using this method is that a missing nozzle, would leave a full dot line missing as a print defect. This defect can be minimized by leaving a light line rather than a fully missing line. This method is illustrated in FIG. 2.

Figure 3:
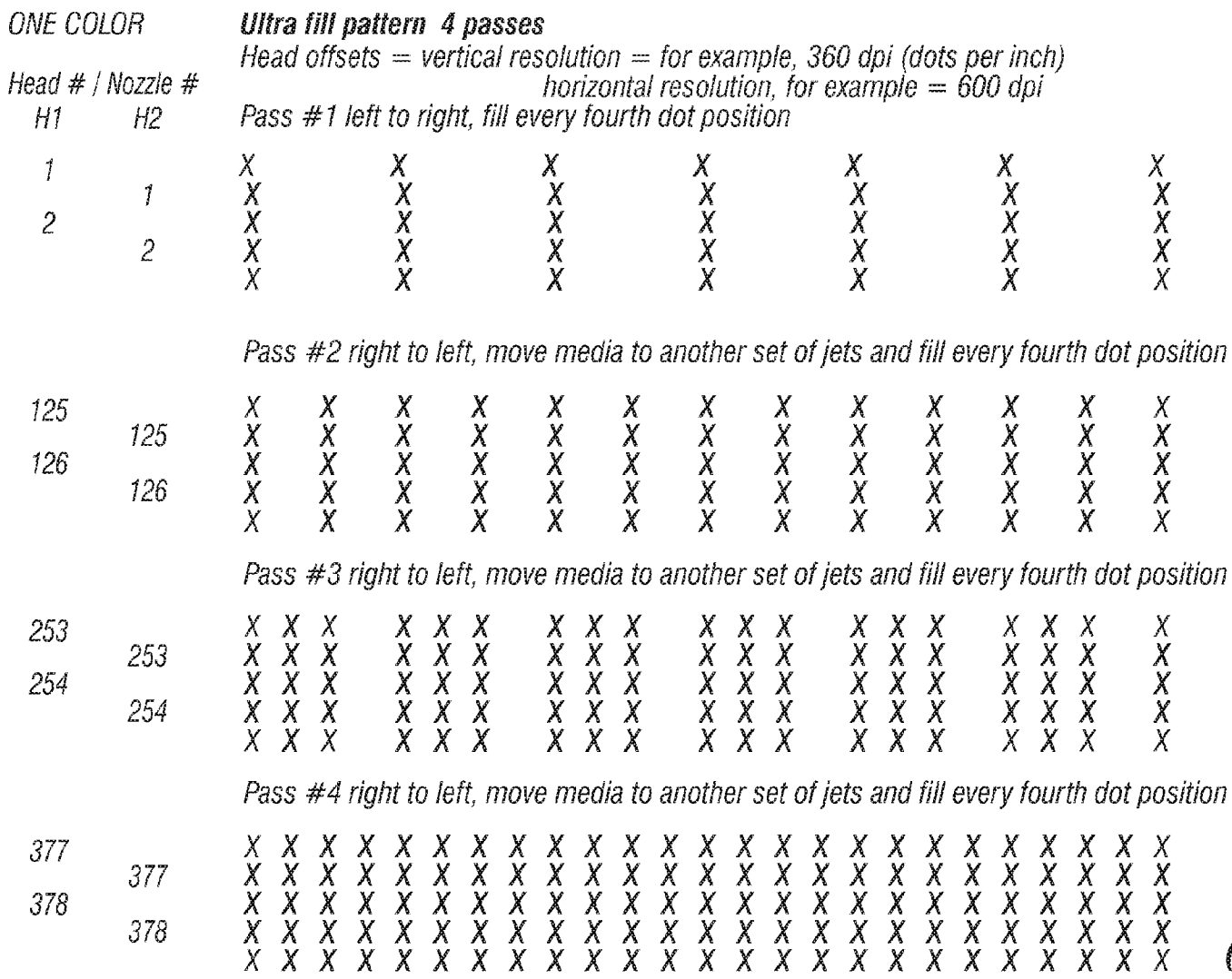
FIG. 3 (Prior Art)
FIG. 3 is a schematic diagram that shows an ultra or four-pass mode of printing.

The second method of interlacing is referred to as the ultra or four-pass mode. In this mode, each dot line is printed by four different nozzles. On the first pass, every fourth dot is printed. The media is moved, and every second dot is printed on the return pass, and so on until all the pixel positions are filled on a line. This is graphically illustrated in FIG. 3.

The third mode is referred to as heavy smoothing and is shown in FIG. 4. Smoothing is a four-pass mode which imposes an error diffusion algorithm on the image that randomizes the order of lay down so that a mix of odd and even numbered pixels is printed on a given pass. This more random lay down leads to an image that is less structured and has reduced gloss banding from the traditional four-pass mode.

Those skilled in the art will appreciate that the invention herein may be used in connection with any of these or other interlacing technique, if desired. Key to the invention is the arrangement of the print heads to cover more of the substrate surface in each pass, where less ink is applied per square inch of substrate, thus reducing the density of the ink applied to the substrate and avoiding the liquid-to-liquid interaction that occurs when ink is applied with less spacing between the ink drops, and that results in such undesirable print artifacts as gloss banding or tire tracking.

Figure 5:
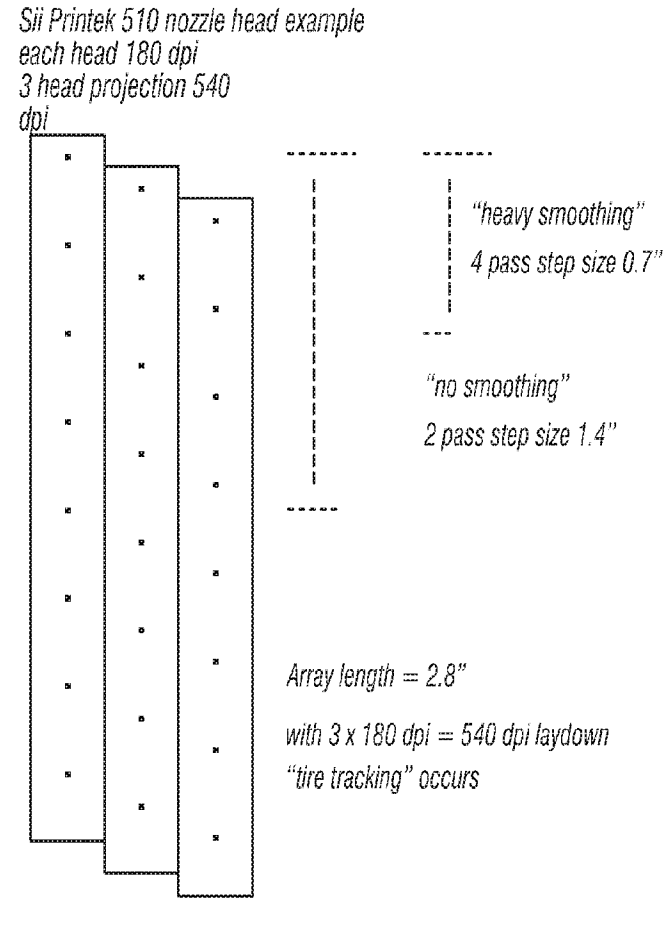
FIG. 5 (Prior Art)
FIG. 5 is a schematic diagram that shows a typical, single color head arrangement for UV inkjet products.

FIG. 5 shows a typical, single color head arrangement for UV inkjet products.

Figure 6:
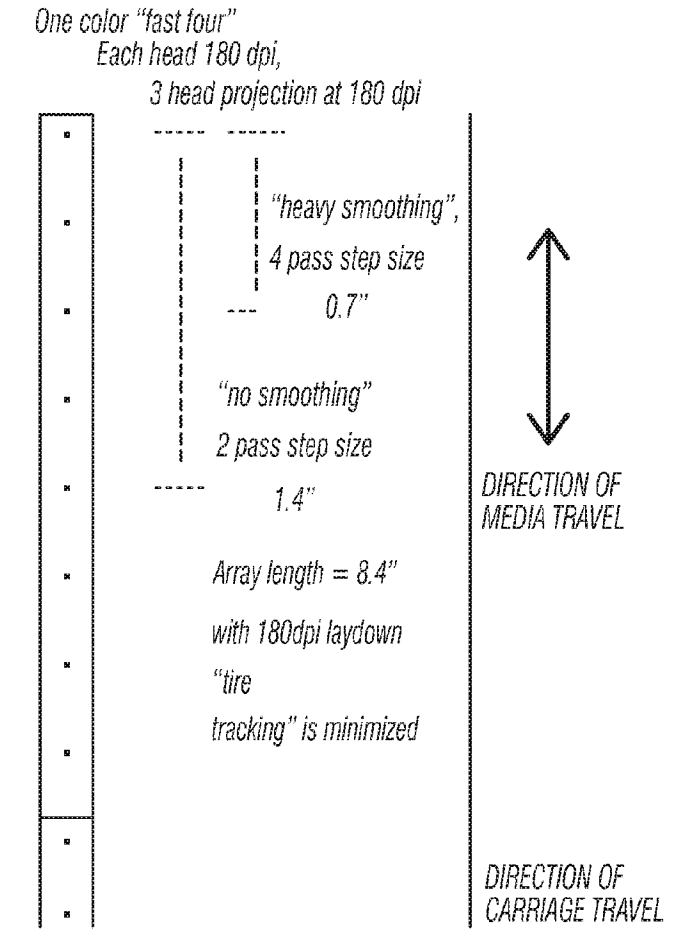
FIG. 6 is a schematic diagram that shows a novel head arrangement according to the invention.

Vertical resolution of each head is 180 dpi, with the projection of the array is 540 dpi. In contrast to the approach of FIG. 5, FIG. 6 shows the novel head arrangement of the herein disclosed invention. In this case, resolution is 180 dpi.

This arrangement allows the vertical resolution to be any multiple of 180 (360, 540, 720, etc.). Those skilled in the art will appreciate that other resolutions are readily applied in keeping with the invention herein.

As can be seen in FIG. 6, a print head array is provided that is 8.4" long. This can be compared to the print head array of FIG. 5, which is 2.8" long. Thus, the conventional print head arrangement applies three times as much ink per square inch over ⅓ the length of the substrate. Put another way, the invention herein applies ⅓ the amount of ink per square ink over three times the length of the substrate.

FIG. 6 illustrates a top down view of ink heads contained on an inkjet printer carriage and having layout pattern according to some embodiments of the invention. In FIG. 6 (see FIG. 1 for an illustration of the specific printer components other than the print heads), the inkjet printer carriage traverses a printer base via a rail in the left-to-right and right-to-left directions, as indicated by the arrow labeled "Direction of Carriage Travel." Likewise, the media (not shown) being printed upon beneath the carriage is moved in a direction substantially perpendicular to the direction traversed by the print heads during each pass, as indicated by the arrow labeled "Direction of Media Travel." As the media moves beneath the print heads, the print heads deposit ink as the carriage traverses back and forth. Preferably, the print heads deposit UV-curable ink. Those skilled in the art will appreciate that the invention is readily practiced with other inks, however.

In some embodiments of the invention, the print heads are grouped in the carriage in various configurations. For example, the print heads can be configured in four groups, each having four colored ink print heads placed on a portion of the print carriage that first passes over the substrate, wherein the substrate first encounters the colored ink print heads during transport through the printing system. Those skilled in the art will appreciate that other arrangements are within the scope of the invention, for example six groups with four groups of colored ink print heads can be placed on the portion of the print carriage that first passes over the media. Accordingly, the media first encounters the colored ink print heads during its transport through the printing system. The groups of colored print heads can be arranged in color clusters defining a standard color model. For example, the groups can contain colors defining the CMYK color model. Those of ordinary skill in the art will readily appreciate that other color models, other arrangements, and other colored inks will equally benefit from the invention.

Key to the invention is the arrangement of the print heads substantially end-to-end, rather than in an offset, side-to-side configuration. While this approach typically requires more passes to print an image, more square inches of the substrate are covered per pass. For purposes of the disclosure herein, this is referred to as an image build. When a print job is started, not all of the nozzles are used because the substrate is not yet positioned beneath the entire print nozzle array. As the printer steps the substrate into the array, a point is reached at which all of the nozzles are used all of the time. The majority of the printing occurs in this fashion, with all of the nozzles in use. At the end of the print job, the substrate is stepped away from the array. As a result, the invention has a relatively small negative effect on throughput when compared to a conventional print head configuration. However, this is only during the first and last few passes. If the printer is operated continuously, then the affect on throughput is very minimal because the step size remains the same for each approach. That is, the substrate is advanced at the same rate and, for multiple sheets, the effect of the gap at the top and bottom of the substrate is further minimized because each sheet of substrate is continuously fed, one after the other, so that the throughput penalty of the invention only occurs at the top of the first sheet and the bottom of the last sheet. For a print job of many sheets, this penalty is negligible.

The invention, in some embodiments, can affect the placement of lamps used by the printer for pinning and curing. In some embodiments, the lamps may be made longer than those used in connection with a conventional print head array because lamps are typically of a greater length than the length of the print head array. The placement of lamps in the direction of motion of the carriage is the same. The lamps in some embodiments may require less energy because the ink is less dense on the substrate, and thus requires less intensity to pin and/or cure. The same amount of total energy is used for the same print job, but it is spread out over a longer array. In some embodiments, pinning is helpful because the invention allows one to use a small amount of energy over the length of the print head array. After the image is completely formed, a final curing step can be performed on the ink. In other embodiments, the cure lamps can cover the full length of, or longer than, the print head array. In some embodiments, the cure lamps are attached to the carriage that carries the print heads, and the length of the lamp is the same or greater than the length of the print heads. In some embodiments, a distinction is made between cure lamps and pinning lamps. In these embodiments, the pinning lamps are preferably the same length or longer than the print head array, and there is an additional cure region after the whole image is formed. Some embodiments use pure post-cure, and do not pin at all (for a discussion of pinning, see U.S. patent application Ser. No. 13/218,233, filed Aug. 25, 2011, which application is incorporated herein in its entirety by this reference thereto). Thus, a cure is performed after the print is completed. In other embodiments, the low-density laydown uses longer, traditional cure lamps. Other embodiments use variable pinning as well.

The interlacing modes can be similar to the three modes described above. This allows the rate of ink lay down per area to be much smaller than previous implementations. Improvements in throughput are achieved by having more ink jet nozzles extended in the vertical direction. In the printer, this is the carriage depth.

FIG. 7 shows a first dot lay down pattern for enhanced or two-pass printing using a state of the art head arrangement. FIG. 8 shows the dot lay down pattern for enhanced or two-pass printing, where the low density array at 180 dpi takes more carriage passes to fill the matrix fully, but has the same throughput as the 540 dpi array with the same number of nozzles. This lower rate of lay down greatly improves the differential gloss banding. It can be seen that the conventional approach of FIG. 7 prints an image in two passes, while the novel approach herein requires six passes to print the same image. However, the approach of FIG. 8 covers three times as much of the substrate in each pass, albeit less densely, with the net effect being near equivalent throughput with each approach. Thus, in an embodiment ink is applied in an inverse ratio defined by ink volume per print head pass, where volume is reduced to reduce banding and the number of passes is increased to print an image.

Figure 9:
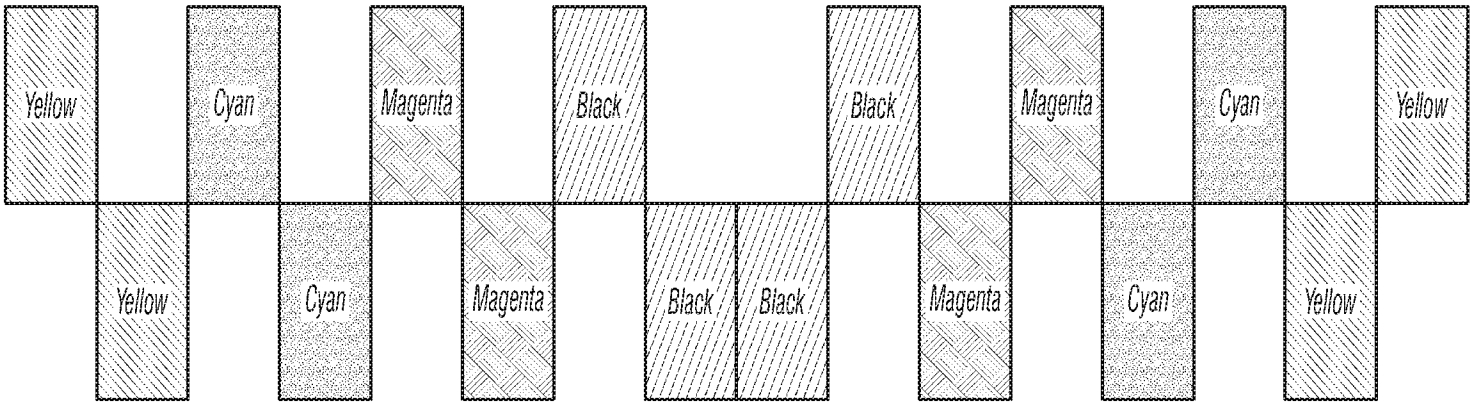
FIGS. 9, 10, and 11 are schematic diagrams that illustrate various head arrangements in accordance with embodiments of the invention
Figure 10:
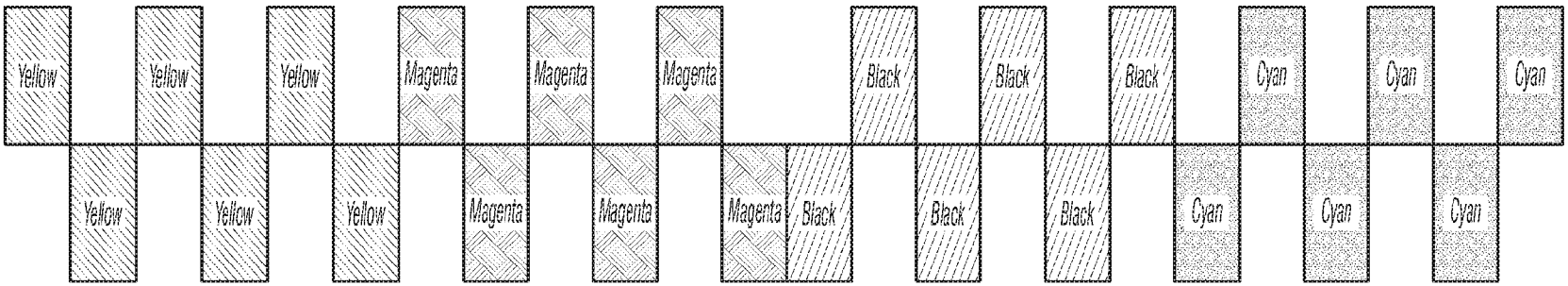
Figure 11:
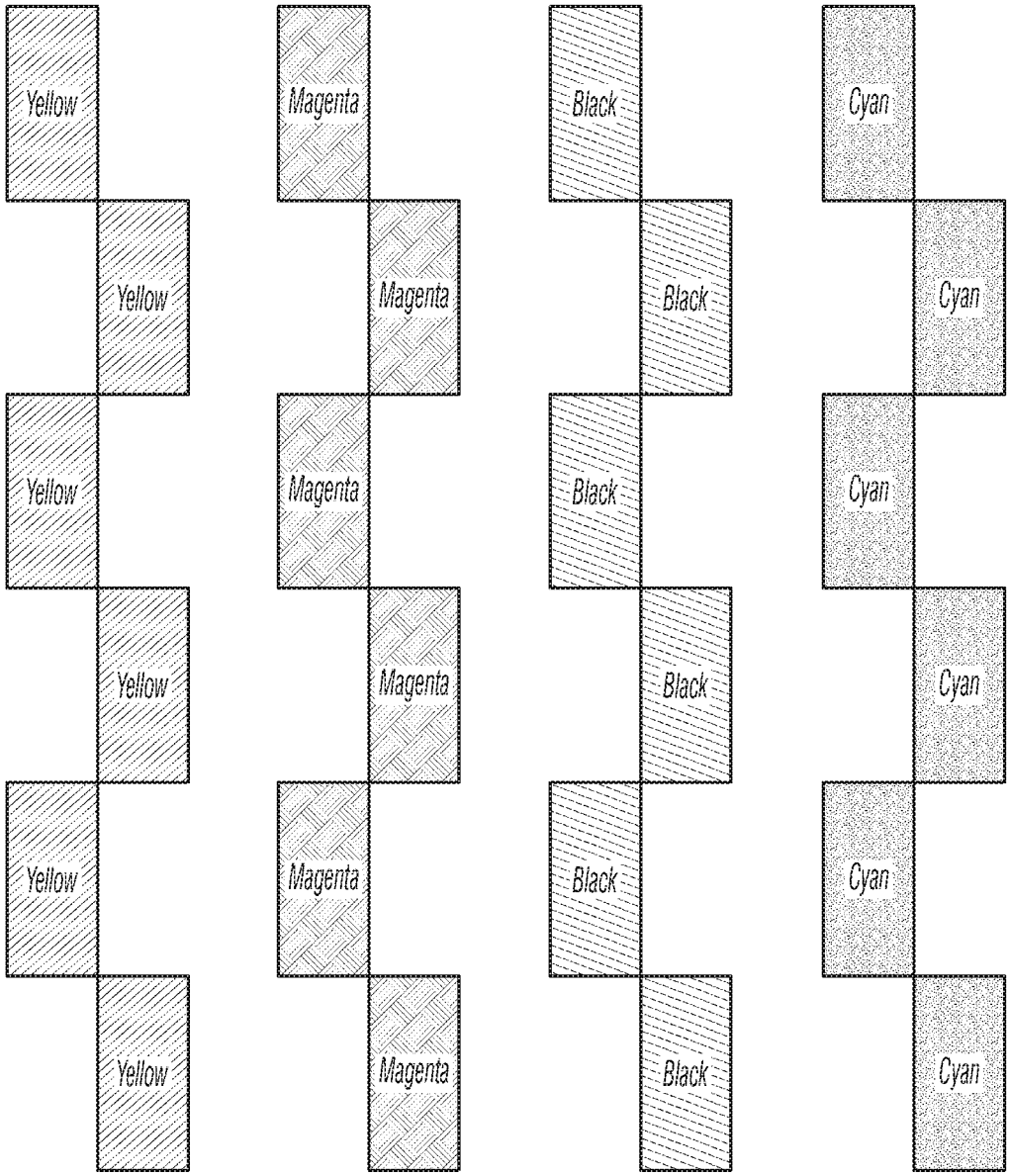

FIGS. 9, 10, and 11 illustrate various head arrangements in accordance with embodiments of the invention. As shown, the heads within a color are offset horizontally to allow for the longer overall length of the head compared with the active nozzle portion. It is important to note that the projection of the heads within a color give a contiguous array of the sum of the heads. For instance, the arrangement shown in FIG. 9 has two heads on each level and though they are not adjacent to one another, they still form a 2×180=360 dpi array to provide printing resolutions of 360, 720, and 1080 dpi; the arrangement shown in FIG. 10 has three heads of native 180 dpi on each level of the array to make a projection of 540 dpi or 1080 dpi; and the arrangement shown in FIG. 11 provides a low density array capable of resolutions of 180, 360, 540, 720, and 1080 dpi. In these embodiments, the heads at native 180 dpi can be made up of two 90 dpi arrays within the head. Those skilled in the art will appreciate that other arrangements may be used to practice the herein disclosed invention.

Figure 12:
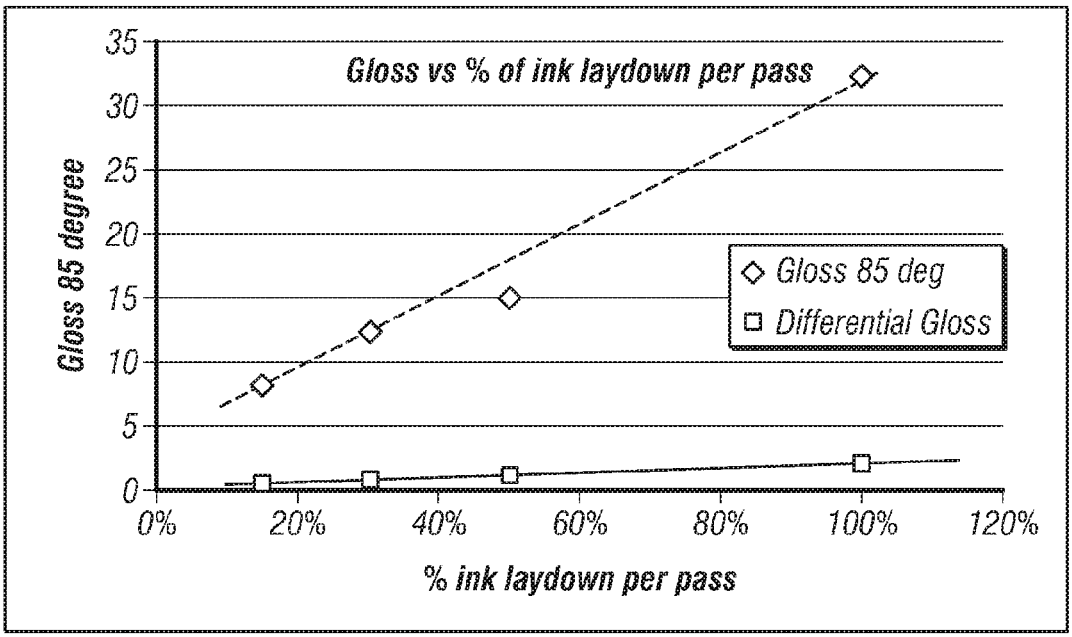
FIG. 12 is a graph that shows a measurement of gloss and gloss differential produced by use of the invention herein disclosed.

Tests were conducted to illustrate the improvement in the gloss and differential gloss by using a lower resolution inkjet head array. The results of one test (FIG. 12) show a measurement of gloss and gloss differential on an EFI Vutek GS3200 printer of a solid area of red from a "Baby Coke Bottle" image. The image is printed in the eight-color mode, with single color arrays of 180 dpi and, in the second instance, with the printer in the fast four color mode with the single color arrays at 360 dpi. In both modes, the images are printed in the NS (no smoothing, two-pass, aka enhanced) mode and the HS (heavy smoothing, aka smoothing, error diffused four-pass) mode. The former printer exhibits improved values for gloss and differential gloss.

Figure 13:
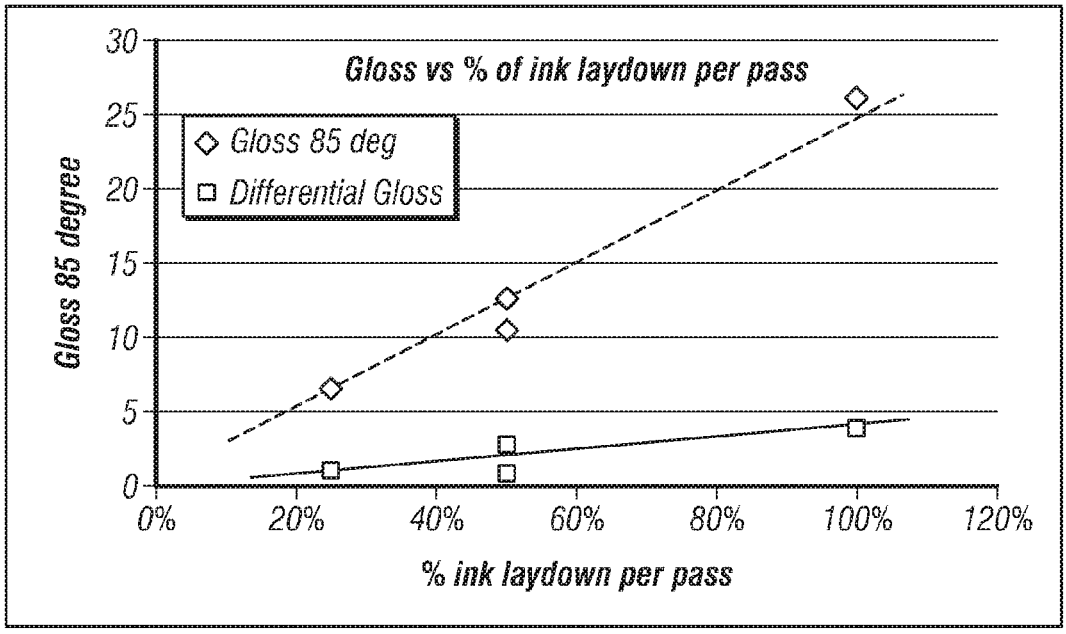
FIG. 13 is a graph that shows a measurement of gloss and gloss differential produced by use of the invention herein disclosed.

The second test (FIG. 13) compares the gloss and differential gloss output from two printers. One printer is a standard GS3200 in the fast four, 360 dpi per color array configuration. The other is a test printer using six heads per color in a 180 dpi array as proposed in the invention disclosure. The latter printer exhibits improved values for gloss and differential gloss.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A system for printing images on a variety of substrates, comprising:

a plurality of print heads, each print head comprising a plurality of substantially adjacent ink nozzles positioned within said print head to define an array of nozzles having m nozzle columns with n nozzles per column, said print head nozzle columns defining a native vertical resolution for said print head, said print heads arranged to position said nozzles within each of said print heads for any one color of ink substantially end-to-end with those nozzles of each other print head on a printing system carriage that is formed to hold said print heads in a configuration that jets out ink individually from each of said nozzles onto a substrate during a multi-pass printing application;

wherein said print heads are arranged to minimize or substantially eliminate gloss banding (tire tracking) by simultaneously applying ink from said nozzles from two or more of said print heads to said substrate over an extended vertical portion of the substrate defined by said plurality of print heads at a density that does not exceed said print head native resolution.

2. The system of claim 1, further comprising:

an interlacing mechanism configured for operating said carriage and said print heads in a two-pass mode, in which each horizontal dot line of an image printed on said substrate is printed by two different print head nozzles;

wherein on one pass, odd number pixel or dots are printed, the substrate is advanced and, on a return pass, even numbered dots are printed by a different set of nozzles.

3. The system of claim 1, further comprising:

an interlacing mechanism configured for operating said carriage and said print heads in a four-pass mode, in which each dot line of an image printed on said substrate is printed by four different nozzles;

wherein on a first pass, every fourth dot is printed, the substrate is moved, and every second dot is printed on a return pass; and wherein printing continue in this fashion until all pixel positions are filled on a line.

4. The system of claim 3, further comprising:

said interlacing mechanism configured for operating said carriage and said print heads in a heavy smoothing mode comprising said four-pass mode, in which an error diffusion algorithm is imposed on an image to randomize ink lay down order and print a mix of odd and even numbered pixels on a given pass.

5. The system of claim 1, said print heads further comprising:

UV-curable inkjet print heads.

6. The system of claim 1, wherein vertical resolution of each print head comprises 180 dpi.

7. The system of claim 1, wherein said vertical resolution of said system comprises a multiple of said native print head vertical resolution.

8. The system of claim 1, further comprising:

said carriage configured for alternately traversing a printer base via a rail in left-to-right and right-to-left directions.

9. The system of claim 8, further comprising:

a transport with which said substrate being printed upon beneath the carriage is moved in a direction substantially perpendicular to the direction traversed by the print heads during each pass.

10. The system of claim 1, further comprising:

said print heads configured in at least four groups, each having at least four colored ink print heads placed on a portion of the print carriage that first passes over the substrate, wherein the substrate first encounters the colored ink print heads during transport through the printing system.

11. The system of claim 10, wherein said groups of colored print heads are arranged in color clusters defining a standard color model.

12. The system of claim 11, said color model comprising a CMYK color model.

13. The system of claim 1, further comprising:

one or more curing and/or pinning lamps associated with the print head array.

14. The system of claim 13, said one or more lamps configured to consume only that amount of energy along their length that is necessary to pin and/or cure said ink applied to said substrate, based upon ink density on said substrate.

15. The system of claim 13, further comprising:

said one or more lamps configured for pinning over the length of the print head array, and for performing a final curing step an image is completely formed on said substrate.

16. The system of claim 13, said one or more lamps further comprising:

one or more cure lamps that cover the full length of, or longer than, the print head array.

17. The system of claim 13, said one or more lamps further comprising:

one or more cure lamps that are attached to the carriage that carries the print heads.

18. The system of claim 1, wherein ink is applied in an inverse ratio defined by ink volume per print head pass, where volume is reduced to reduce banding and a number of print head passes is increased to print an image.

19. A method for printing images on a variety of substrates, comprising:

providing a plurality of print heads, each print head comprising a plurality of substantially adjacent ink nozzles positioned within said print head to define an array of nozzles having m nozzle columns with n nozzles per column, said print head nozzle columns defining a native vertical resolution for said print head, said print heads arranged to position said nozzles within each of said print heads for any one color of ink substantially end-to-end with those nozzles of each other print head on a printing system carriage that is formed to hold said print heads in a configuration that jets out ink individually from each of said nozzles onto a substrate during a multi-pass printing application; and arranging said print heads to minimize or substantially eliminate gloss banding (tire tracking) by simultaneously applying ink from said nozzles from two or more of said print heads to said substrate over an extended vertical portion of the substrate defined by said plurality of print heads at a density that does not exceed said print head native resolution.

* * * * *